United States Patent [19]

Martin

[11] Patent Number: 4,838,188

[45] Date of Patent: Jun. 13, 1989

[54] SEWING GROUP WITH A FEED DEVICE

[75] Inventor: August Martin, Morbach, Fed. Rep. of Germany

[73] Assignee: Pfaff Industriemaschinen GmbH, Fed. Rep. of Germany

[21] Appl. No.: 241,020

[22] Filed: Sep. 2, 1988

[30] Foreign Application Priority Data

Sep. 2, 1987 [DE] Fed. Rep. of Germany ..... 3729256

[51] Int. Cl.[4] ..... D05B 21/00

[52] U.S. Cl. ..... 112/121.12; 112/104

[58] Field of Search ..... 112/121.12, 121.15, 112/121.11, 104, 102, 103, 308, 309, 113

[56] References Cited

U.S. PATENT DOCUMENTS 4,073,252 2/1978 Dobner et al. ..... 112/265.1

4,711,189 12/1987 Muller et al. ..... 112/104 X 4,732,096 3/1988 Mall ..... 112/121.12

*Primary Examiner*—Peter Nerbun

*Attorney, Agent, or Firm*—McGlew & Tuttle

[57] ABSTRACT

A sewing group is associated with a sewing machine and a feed device and comprises a work-holder drivable by two links supported on respective slides which are moved by separate stationary positioning motors which drive the respective slides. The maximum drive forces supplied in the two directions of movement of the feed device are as nearly equal as possible. Links are articulatedly connected with a work-holder for the transmission of exclusively axial forces. At the work-holder is pivoted one end of a guide arm structure whose other end is received for rotary movement in a longitudinal guide. Due to the equivalent load on the two links 13, 26 there result, for the positioning motors, equal drive conditions and equal maximum forces. The feed device is especially suitable for sewing groups with work-holders drivable by step motors.

8 Claims, 2 Drawing Sheets

SEWING GROUP WITH A FEED DEVICE

BACKGROUND OF THE INVENTION

Field of the Invention

This invention relates, in general, to sewing machines and, in particular, to a new and useful sewing group which is connectible to a feed guide for the purpose of effecting specific sewing operations.

The invention relates particularly to a sewing group such as is known through German patent No. 3,407,338 corresponding to U.S. Pat. No. 4,555,998. To achieve lower inertia, its feed device has only two rotatably mounted links, each mounted on a slide which is displaceable in a straight line and connected via a toothed belt drive to a positioning motor for each. At the end of one of the two links a work-holder is arranged. During operation there occur at the link carrying the work-holder, in addition to the drive forces directed parallel to the longitudinal axis of the link, additionally also bending loads due to perpendicularly directed forces at its coupling point with the other link. These bending loads are absorbed by the fact that the link carrying the work-holder has a rigid center rod and a transverse rod connected with the work-holder. The ends of the transverse rod are connected with the other end of the link through tensioned spring steel strips. These measures however, involve considerable engineering expense.

This arrangement of the work-holder at the end of one of two coupled links, known also in older feed devices composed of four links in parallelogram arrangement (German patent No. 2,457,534) corresponding to U.S. Pat. No. 4,073,252, results furthermore in unequal drive conditions for the two directions of movement of the feed device. Also, for the feed in longitudinal directions of the coupled link, much greater forces must be supplied than for the feed in longitudinal direction of the link carrying the work-holder. These unequal forces are mastered without a problem by the cam drives used in the older feed devices. In a feed device equipped with two step motors, on the contrary, great differences between the drive forces maximally to be supplied may necessitate both the use of different drive ramps for the operation of the step motors and also a disproportionately great reduction of the maximum speed of the motors.

SUMMARY OF THE INVENTION

The invention provides a sewing group with a feed device in such a way that the maximum forces occurring in the movement directions of the feed device are substantially the same.

According to the invention, both links are articulatedly connected with the work-holder. The guiding function, which previously was fulfilled as well as by the link carrying the work-holder in addition to its drive function is transferred to a guide arm fastened to the work-holder. Exclusively axially directed forces occur in both links. Because of the equal load on the two links, more uniform drive forces result for the positioning motors, i.e. their maximum values are essentially the same. As a result, the two positioning motors can be operated within a speed range identical for both motors, so that both a higher average speed and a more uniform dynamic behavior of the entire feed device is achieved.

German patent application No. P 36 07 107.2 which corresponds to U.S. Pat. No. 4,711,189 does indeed relate in its second embodiment to a sewing group with a feed device for a work-holder where the work-holder is connected with two links as well as with a third rod type drive part, but it serves exclusively as an auxiliary link transmitting axially directed forces which together with one of the two first links and a common slide forms a parallel-link drive. The aim in constructing the parallel link drive is not to equalize the maximum drive forces to be supplied by the two driving motors, but only to stabilize the angular position of the work-holder.

An advantageous embodiment is one in which the guiding arm comprises two low-mass rigid rods which at one end act on the work-holder at one of the two mutually spaced points of articulation of each of the two links and, at the other end, are rotatably mounted on a common joint of a longitudinally guided slide. The two rods, arranged in triangular connection and engaging at existing points of articulation, constitute an especially low-mass and structurally simple realization of a guide arm.

A symmetrical arrangement of the links with respect to the guide arm is an optimum prerequisite for obtaining uniform drive forces of the two motors.

Accordingly, it is an object of the invention to provide a sewing group drive for use with a sewing machine and a feed device which includes a drivable work holder and which comprises first and second guides having a slide movable on each guide which is connected to one end of respective first and second links and which are driven by stationary motors and wherein the links have opposite ends which are articulated to the work-holder and which also includes a stationary slide guide with a guide arm which is pivotally connected to the work-holder and has an opposite end which is received displaceably and rotatably in its stationary guide.

A further object of the invention is to provide a sewing group drive which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

GENERAL DESCRIPTION OF THE PREFERRED EMBODIMENTS

Figure 1:
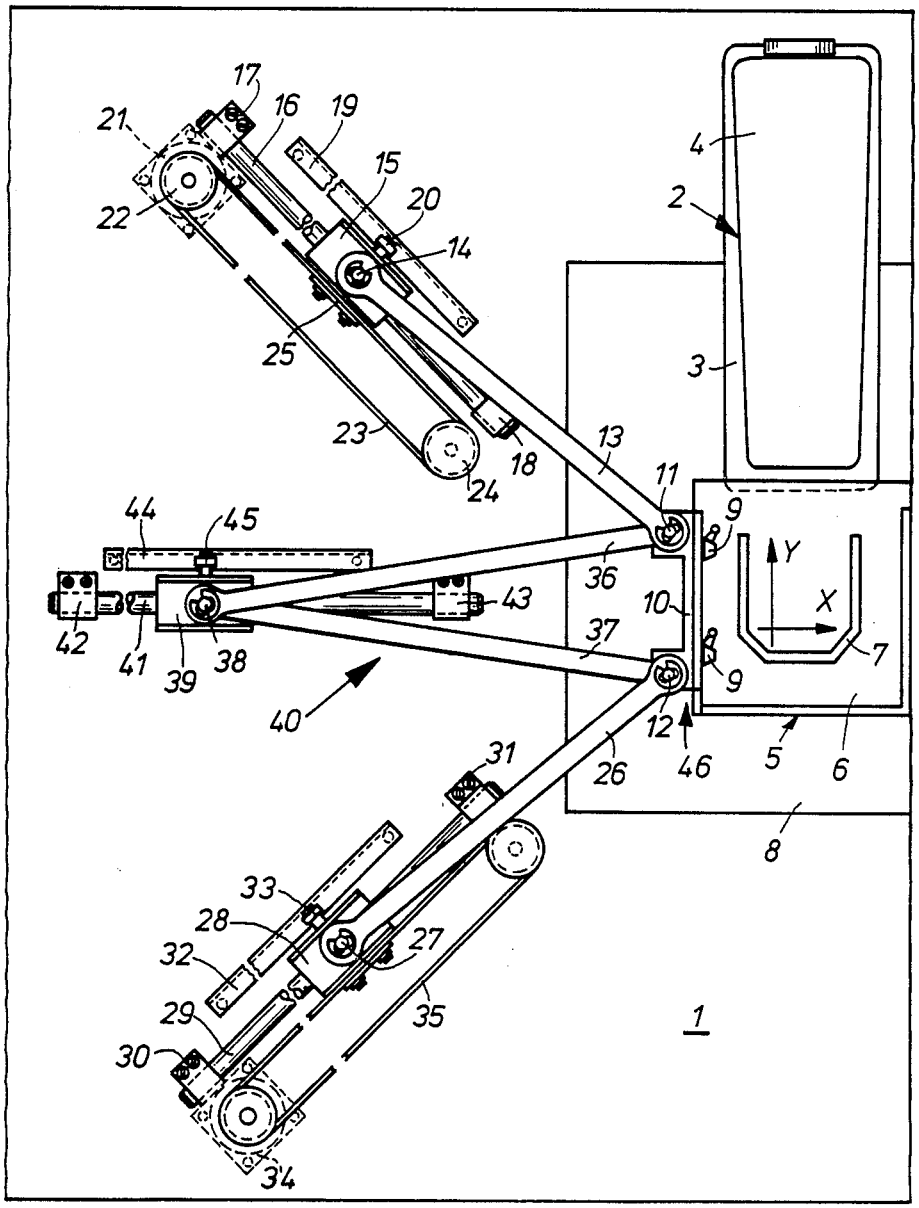
FIG. 1 is a top view of a first embodiment of a sewing group constituted in accordance with the invention.

Referring to the drawings, in particular, the invention embodied therein comprises a sewing group drive for use with a sewing machine 2 and which includes a work-holder or feed device 5 which is engaged by and driven by links 13 and 26 and is guided by a guide arm generally designated 40 which is made up of a pair of triangularly arranged rods 36 and 37.

On a table top 1 a sewing machine 2 is arranged, of which are shown the base plate 3 and the arm 4 terminating in a head.

A work-holder 5 serves to receive the work to be sewn and has plate 6 which frictionally grips the work and which for passage of the sewing machine needle (not shown) is provided with a cutout 7 corresponding to the form of the seam to be made. Plate 6 rests on a support plate 8 secured on the table top 1. The top of the support plate is flush with the top of the base plate 3 of the sewing machine 2.

The work-holder 5 is releasably connected by clamp screws 9 to a holding piece 10, in which are received two hinge pins 11, 12.

Disposed on the hinge pin 11 is one end of a link 13 formed by a rigid low-mass hollow section. The other end of link 13 is mounted on a hinge pin 14 disposed on a slide 15. Slide 15 moves on a slide rod 16, whose ends are received in two bearing blocks 17, 18 secured to the table top 1. Fastened on the table top 1 is a guide rail 19 of U-shaped cross section extending parallel to the slide rod 16. The upper leg of the guide rail 19 is spanned by a roll pair, of which only the upper roll 20 is shown.

On the underside of the table top 1 a step motor 21 is arranged, which drives a toothed belt wheel 22. Disposed on the belt wheel 22 is a toothed belt 23 which runs around a guide wheel 24 rotatably arranged on the table top 1, the belt sections between the wheels 22 and 24 running parallel to the slide rod 16. The toothed belt 23 is firmly connected with the slide 16 via a pressure plate 25.

Disposed on the hinge pin 12 is one end of a link 26, which is constructed like link 13 and therefore also includes a rigid, low-mass hollow section. The other end of the link 26 is mounted on a hinge pin 27 which is arranged on a slide 28. Slide 28 is displaceable on a slide rod 29 whose ends are received in two bearing blocks 30, 31 secured on the table top 1. On the table top 1 is fastened a guide rail 32 of U-shaped cross section extending parallel to the slide rod 29. The upper leg of the guide rail 32 is spanned by a roll pair, of which only the upper roll 33 is shown.

On the underside of the table 1 a step motor 34 is arranged, Which is in drive connection with slide 28 in the same manner as is the case for the previously described step motor 21 and the associated slide 15.

On the hinge pin 11 is arranged further one end of a rod 36 which comprises a rigid, low-mass hollow section. In the same manner there is arranged on the hinge pin 12 one end of a rod 37 which also comprises a rigid, low-mass hollow section.

The opposite ends of the two rods 36 and 37 are mounted on a hinge pin 38 which is disposed on a slide 39. The two rods 36, 37 are in triangle connection with the holding piece 10 and thus form a rigid guide arm 40.

The slide 39 is displaceable on a slide rod 41, whose ends are received in two bearing blocks 42, 43 secured on the table top. On the table top 1 is fastened a guide rail 44 of U-shaped cross section which extends parallel to the slide rod 41. The upper leg of guide rail 44 is spanned by a roll pair, of which only the upper roll 45 is shown.

Parts 5 and 45 form the feed device 46 for the work to be sewn.

Figure 2:
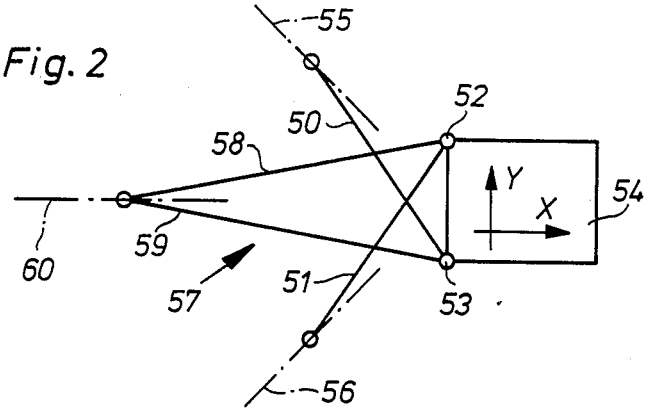
FIGS. 2 to 4 are diagrams of three additional embodiments of the invention.

In the embodiment example schematically represented in FIG. 2, the links 50 and 51 are arranged crosswise, owing to which their points of articulation 52, 53 on the work-holder 54 are interchanged as compared with the embodiment example according to FIG. 1. The respective other ends of the links 50, 51 is received, as in the example according to FIG. 1, for rotation or pivoting in a stationary guide 55, 56 and are connected to a positioning motor for each, not shown. Engaging at the points of articulation 52, 53 are two rods 58 and 59 forming a guide arm 57, and their other ends are rotatably received, as in the example of FIG. 1, in a common stationary guide 60. By the crosswise arrangement of the links 50, 51, a compact construction of the device is achieved.

Figure 3:
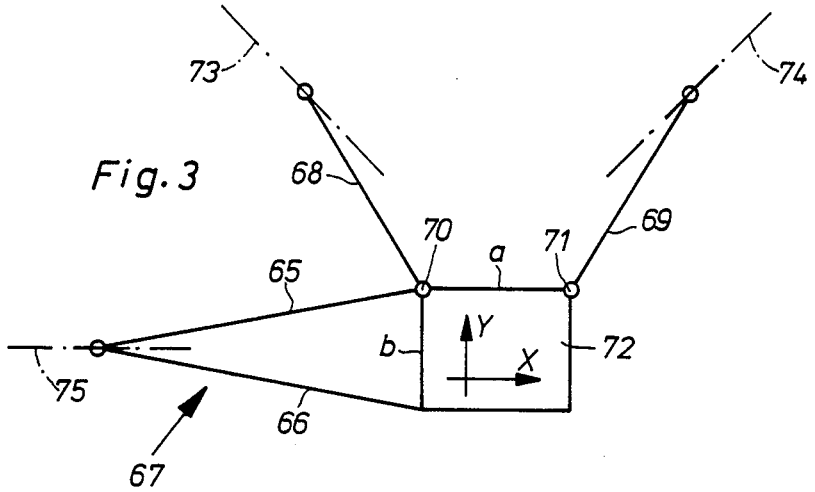

Another possibility for achieving a compact construction is illustrated in FIG. 3. In this case, the guide arm 67, formed by two rods 65, 66, is asymmetrically offset relative to the two links 68, 69, i.e., the points of articulation 70, 71 of the two links 68, 69 are located on one side (a) of the work-holder 72, while the rods 65, 66 are arranged on a side (b) extending at an angle 90° to side (a). The guides of the two links 68, 69 are marked 73, 74. The guide of the guide arm 67 has the reference symbol 75.

Figure 4:
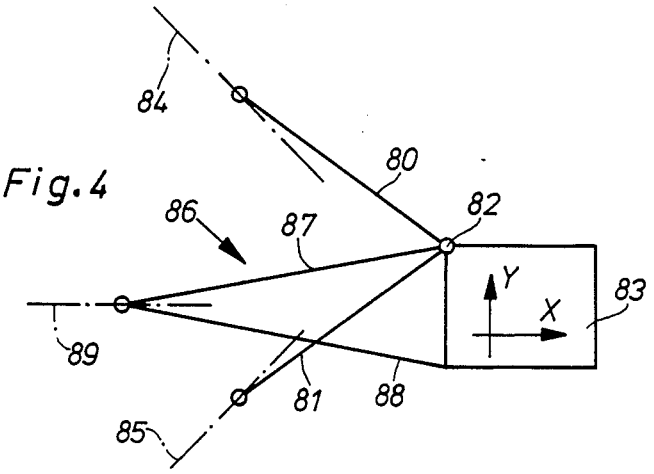

In the embodiment represented schematically in FIG. 4, the two links 80, 81 act on the work-holder 83 at a common point of articulation 82. The guides of the two links 80, 81 are marked 84, 85. The guide arm 86 is formed by two rods 87, 88 of which rod 87 engages at the point of articulation 82 of the two links 80, 81, while rod 88 is fastened at the adjacent corner of the work-holder 83. The guide of guide arm 86 is marked 89.

The sewing group operates as follows:

The sewing group serves, for example, to sew pockets on garments. The work-holder 5 released from the holding piece 1 is placed on the respective garment and pocket in such a way that the cutout 7 is where the seam is to be formed. Then the work-holder 5 while retaining the garment and pocket by friction is moved along on the support plate 8 and again connected with the holding piece 10. Thereafter, the processing cycle of the sewing group can be started.

First, with the sewing machine 2 still standing still, the work-holder 5 is moved from the inactive position shown in the drawing into the sewing position, in that the step motors 21,34 execute programmed in time overlap a corresponding number of drive steps. Control of the step motors 21 and 34 occurs through a known microcomputer not shown, which computes the required number of drive pulses for each of the two step motors (21, 34) from position data contained in a memory.

The step motors 21, 34 drive the toothed belts 23, 35, which in turn displace the slides 15,28 on the slide rods 16, 29. The movement of the slides 15 and 28 is transmitted to the respective links 13 and 26, the work-holder 5 being thus displaced on the support plate 8 relative to the sewing machine 2 in a manner established in the program, until the point where the seam is to begin is under the needle of the sewing machine. The guide arm 40, which at one end is firmly connected with the work-holder 5 and at the other end is rotatably (pivotally) mounted on the longitudinally guided slide 39, always brings about a clearly defined angular position of the work-holder 5 depending on the respective positions of the two links 13, 26, so that the work-holder can be moved or positioned with precision.

After the work-holder 5 has reached the sewing position, the sewing machine 2 is turned on, whereupon the desired seam is formed in cooperation with the program-controlled step motors 21,34.

While the work-holder 5 is moved quasi continuously as it moves from the inactive to the sewing position, during the sewing process it is displaced only when the needle is outside the work, so that it executes an intermittent movement. Because the links 13,26 are coupled to the work-holder 5 rotationally movable, the then occurring jerky driving and inertial forces are transmitted exclusively in axial directions, so that apart from the longitudinally directed normal forces no transverse forces act on the links 13 and 26 that would produce a bending moment. Since thus there occurs in the links 13 and 26 always equivalent forces and since moreover the links 13, 26 are arranged symmetrically to the guide arm 40, substantially equal maximum drive forces must be supplied by the step motors 21, 34 in the two directions of movement (x and y).

Under substantially equal maximum load a more uniform dynamic behavior of the entire feed device 46 results, and the two step motors 21 and 34 can be operated within a speed range equal for both motors and hence with equal drive ramps.

As the two rods 36,37 of the guide arm 40 form together with the holding piece 10 a triangle connecting, in them, too, only longitudinally directed normal forces occur, owing to which the rods 36, 37 may be formed to have very little mass.

In the feed devices of FIGS. 2 to 4, substantially the same dynamic conditions occur as in the above-described embodiment example, as the mutually associated links 50, 51; 68, 69; and 80, 81 are articulatedly connected with the respective work-holder 54; 72; 83 and the guide arms 57,67 and 86 also have pairs of rods 58,59; 65, 66; 87, 88 forming a triangle condition.

While specific embodiments of the invention have been shown and described in detail to the application of the principles of the invention, it will be understood that the invention may be embodied otherwise without departing from such principles.

What is claimed is:

1. A sewing group drive for use with a sewing machine and a feed device which includes a drivable work-holder, comprising first and second slide guides, a slide movable on each of said first and second guides, first and second links having one ends supported on the respective first and second slide and having opposite ends, first and second stationary positioning motors in drive connection with respective first and second slides, said first and second link opposite ends being articulatedly connected with the work-holder for transmission of exclusively axial forces, a stationary slide guide, a guide arm having one end connected to the work-holder and having an opposite other end received displaceably and rotatably on said stationary guide.

2. A sewing group according to claim 1, including a guide arm slide movable on said stationary slide guide, said guide arm opposite end being pivotally mounted in said guide arm slide.

3. A sewing group according to claim 1, wherein said first and second links opposite ends engage the work-holder at spaced-apart locations, said guide arm comprising first and second rigid rods of low mass, each of said rigid rods having one rod end which engage the work-holder at the same location as said link opposite end, said rigid rods having opposite rigid rod ends, a longitudinal slide guide, a longitudinally movable slide on said longitudinal slide guide pivotally connected to the opposite ends of said rigid rods.

4. A sewing group according to claim 3, wherein said links are connected to the work-holder at respective remote sides of the work-holder so that they cross each other.

5. A sewing group according to claim 1, wherein said guide arm is offset asymmetrically relative to said links.

6. A sewing group according to claim 1, wherein said links have a common point of articulation at said work-holder.

7. A sewing group drive according to claim 1, wherein said first and second slides includes a slide rod mounted in a stationary position, a respective first and second slide engageable on said first and second slide rods for movement therealong, and a gear belt connected between said motors and said first and second slides for driving said slides.

8. A sewing group according to claim 2, wherein said guide arm slide of said first and second slide guides are arranged symmetrically in respect to said stationary slide guide.

* * * * *